US007530637B1

(12) United States Patent
Wu

(10) Patent No.: US 7,530,637 B1
(45) Date of Patent: May 12, 2009

(54) CHAIR ASSEMBLY

(76) Inventor: Yao-Chuan Wu, No. 1-1, Nei Pu Tsai, Ta Chi Tsun, Minhsiung Hsiang, Chiayi Hsien, 261 (TW)

( * ) Notice: Subject to any disclaimer, the term of this patent is extended or adjusted under 35 U.S.C. 154(b) by 0 days.

(21) Appl. No.: 12/050,241

(22) Filed: Mar. 18, 2008

(51) Int. Cl.
*A47C 1/032* (2006.01)

(52) U.S. Cl. ..... 297/300.5; 297/303.4; 297/317; 297/322

(58) Field of Classification Search ..... 297/300.1, 297/300.5, 301.4, 303.4, 317, 322
See application file for complete search history.

(56) References Cited

U.S. PATENT DOCUMENTS 4,695,093 A * 9/1987 Suhr et al. ..... 297/303.4
4,840,426 A * 6/1989 Vogtherr et al. ..... 297/300.5
5,192,114 A * 3/1993 Hollington et al. ..... 297/300.5
5,725,276 A * 3/1998 Ginat ..... 297/301.4
5,909,924 A * 6/1999 Roslund, Jr. ..... 297/300.4
6,419,320 B1 * 7/2002 Wang ..... 297/344.19
6,712,428 B2 * 3/2004 Moreschi ..... 297/303.4
6,758,523 B2 * 7/2004 VanDeRiet et al. ..... 297/300.5
6,929,327 B2 * 8/2005 Piretti ..... 297/300.2
6,945,603 B2 * 9/2005 Elzenbeck ..... 297/303.4
7,014,262 B2 * 3/2006 Rossetto et al. ..... 297/300.8
7,147,285 B2 * 12/2006 Lin ..... 297/301.1

* cited by examiner

*Primary Examiner*—Peter R. Brown
(74) *Attorney, Agent, or Firm*—Alan Kamrath; Kamrath & Associates PA

(57) ABSTRACT

A chair assembly has a chassis connected between a backrest frame and a pneumatic foot rod. The backrest frame has a pivotal hole and has an elongated slot to receive a sliding pivotal rod pushed by a spring so that the backrest frame is controlled by the sliding pivotal rod when the backrest frame pivotally moves relative to the chassis. Because the incline of backrest frame is controlled by an adjusting wheel pushing the spring and because the seat frame has a rocking board to support the backrest frame, the chair assembly is able to change the inclined angles of the backrest frame. Moreover, the seat frame has a sliding base for attaching a pad. Thereby, the chair assembly has adjustable functions.

4 Claims, 7 Drawing Sheets

CHAIR ASSEMBLY

BACKGROUND OF THE INVENTION

1. Field of the Invention

The present invention relates to a chair assembly and, more particularly, frame assembly that comprises a chassis, a backrest frame pivotally adjustably mounted on the chassis and a pneumatic foot rod attached under the chassis so that the chair assembly performs multiple adjustable functions.

2. Description of Related Art

In designing to meet human needs, a chair has an operational structure with multiple functions to meet a user's expectation for comfort. Therefore, the conventional chair usually provides the functions such as the seat elevating, the backrest inclining, and the seat moving forward or backward to make the chair in use adjustable corresponding to human engineering.

However, when the conventional chair is designed, various adjustment devices are respectively attached to a chassis. Because each adjustment device is an independent component and occupies a certain space but the chassis is limited in space, the chassis has a huge size and a heavy weight. Moreover, the user has to indirectly drive the adjustment devices by multiple controlling rods. The controlling rods for the various adjustment functions extend out of the chassis so as to cause troublesome protection issues during transportation and to cause an unpleasant appearance.

SUMMARY OF THE INVENTION

A main objective of the present invention is to provide a chair assembly, wherein the chair assembly integrates multiple adjustment devices in a chassis to significantly diminish size.

To achieve the foregoing objective, the chair assembly comprises a chassis mounted over a pneumatic foot rod, a backrest frame and a seat frame pivotally combined with each other, wherein the pneumatic foot rod is a pneumatic rod immovably mounted on a foot pedestal and has a top surface and a controlling button formed on the top surface;

the backrest frame has a front end and two supporting rods formed on the front end and correspondingly pivotally mounted on two sides of the chassis, with each supporting rod having a pivotal hole and an engaging hole, and with the backrest frame having a rear end with a recess to connect with a backrest of a chair;

the seat frame for resting a chair pad has a front end with a connecting rod engaged to a front end of the chassis and has a rear end pivotally attached to the backrest frame; and the chassis comprises a tube engaged to the pneumatic foot rod and comprises a dish-like base with a controlling button driven by a wire-controlled triggering element, with a middle section of the chassis having two pivotal holes respectively defined on the two sides of the chassis, with an elongated slot defined on the chassis below each of the two pivotal holes to receive a sliding pivotal rod that is abutted by a spring of a pressing board, with pressing board driven by threads on a shaft of an adjusting wheel that is driven by an engagement gear with a transmitting crank, and with two engaging holes defined on the two sides at the front end of the chassis.

Thereby, the chair assembly has multiple adjustment functions.

Further benefits and advantages of the present invention will become apparent after a careful reading of the detailed description with appropriate reference to the accompanying drawings.

DETAILED DESCRIPTION OF THE PREFERRED EMBODIMENT

A chair assembly in accordance with the present invention comprises a chassis for a backrest frame pivotally mounted thereon and a pneumatic foot rod connecting thereto. The chassis has a pivotal hole with an elongated slot to receive a sliding pivotal rod of the backrest frame, with the sliding pivotal rod being pushed by a spring. Thus, the backrest frame is controlled by the sliding pivotal rod when the backrest frame pivotally moves relative to the chassis. Because the incline of the backrest frame is controlled by pushing of the spring by an adjusting wheel and because the seat frame has a rocking board connected to the backrest frame to support the backrest frame, the chair assembly allows the inclined angles of the backrest frame to be changed. Moreover, the seat frame has a sliding base for attaching to a pad. By having the abovementioned structure, the chair assembly has adjustable functions of backrest inclining, pad inclining and sliding, and seat elevating.

Figure 1:
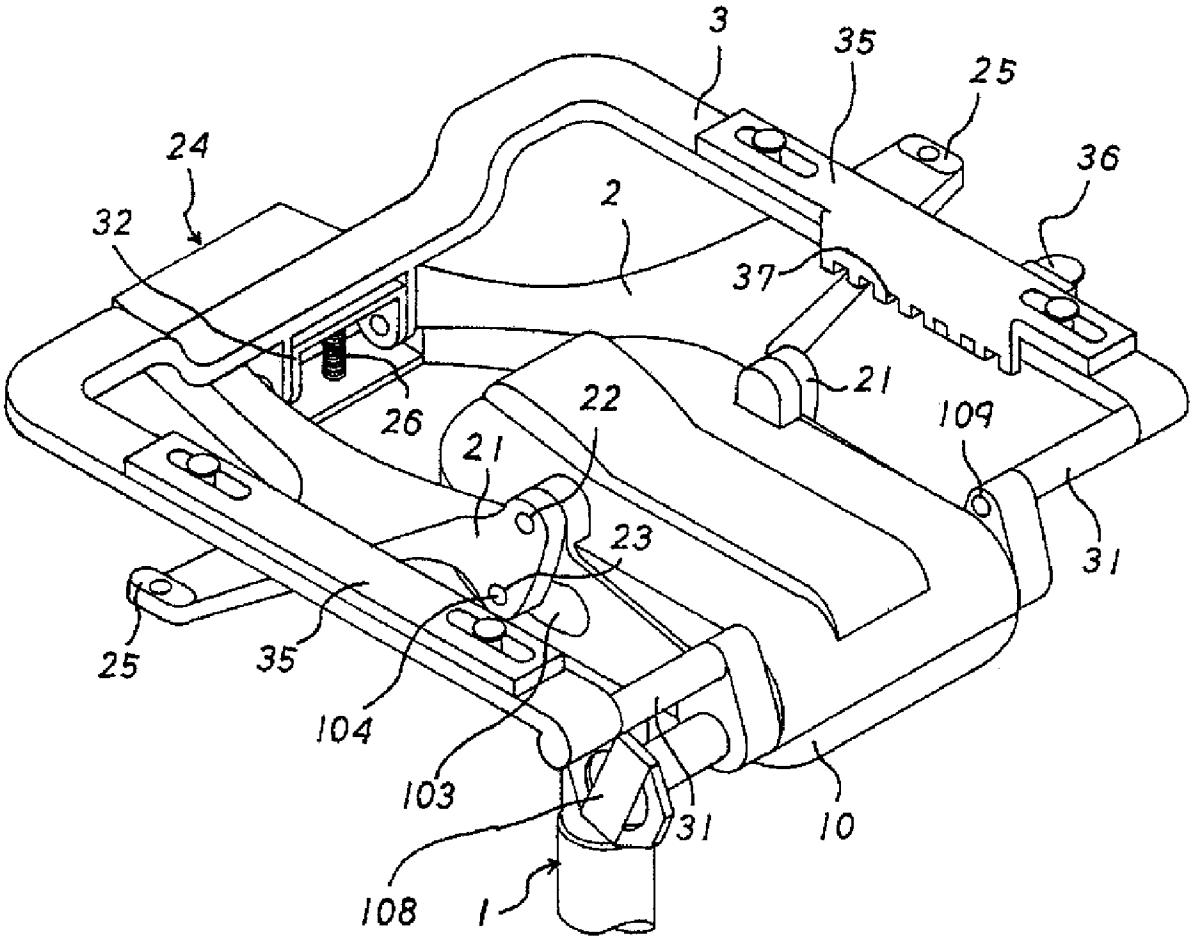
FIG. 1 is a perspective view of the chair assembly in accordance with the present invention.

As shown in FIG. 1, a preferred embodiment of the chair assembly comprises a chassis 10 mounted on a pneumatic foot rod 1 to pivotally connect with a backrest frame 2 and the seat frame 3.

Figure 4:
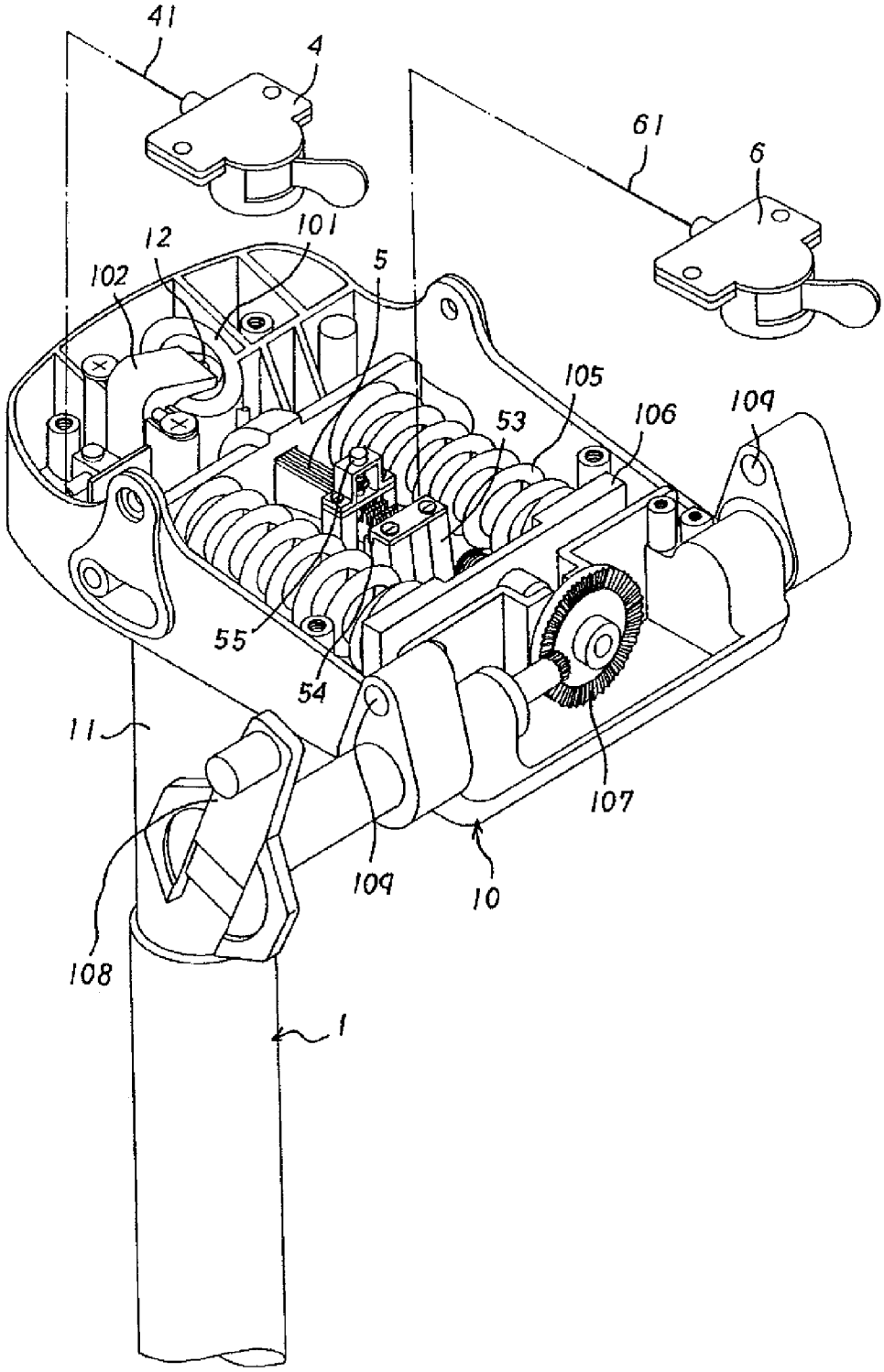
FIG. 4 is a perspective view of the chassis combining with adjacent elements.

The pneumatic foot rod 1 is a pneumatic rod 11 immovably mounted on a foot pedestal and has a top surface and a controlling button 12 formed on the top surface (as shown in FIG. 4).

Figure 2:
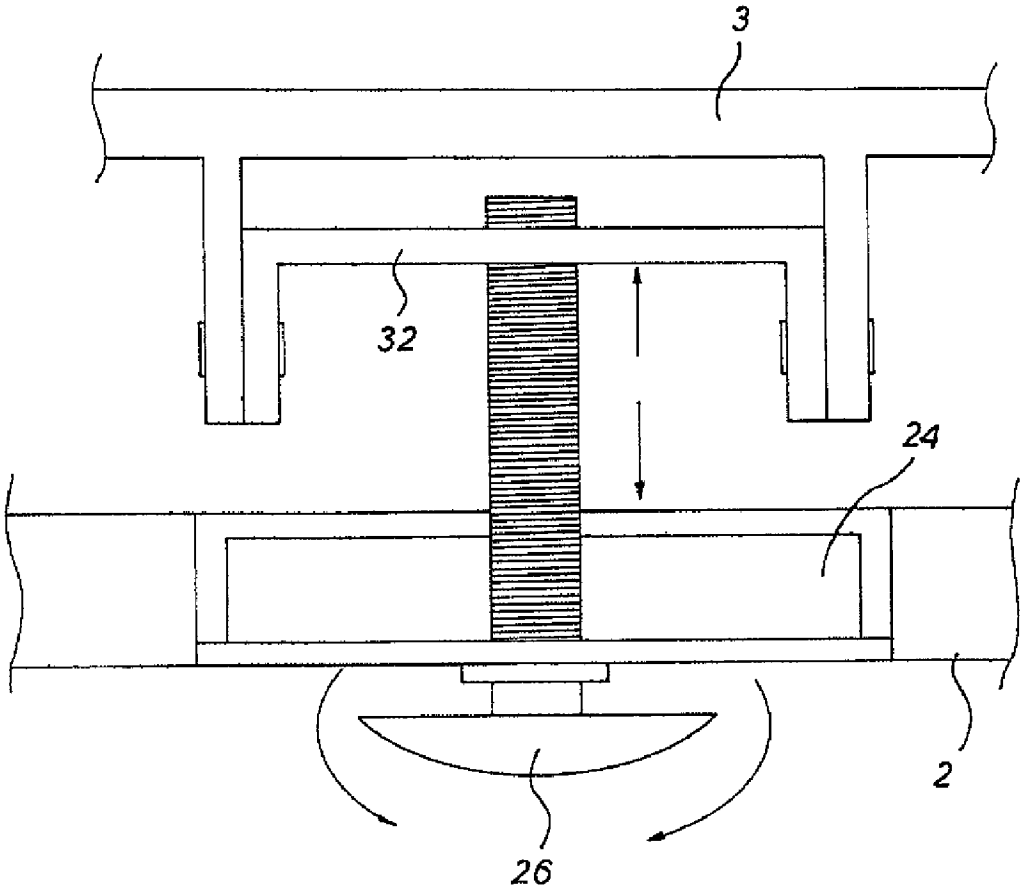
FIG. 2 is a partial side view showing a combination of a backrest frame and seat frame in the present invention.

The backrest frame 2 has a front end and two supporting rods 21 formed on the front end and correspondingly pivotally mounted to two sides of the chassis 10. Each supporting rod 21 has a pivotal hole 22 and an engaging hole 23. The backrest frame 2 has a rear end with a recess 24 to connect to a backrest of a chair. A screw rod 26 extends upwardly from the rear end of the backrest frame 2. As shown in FIG. 2, the backrest frame 2 has arm connectors 25 attached to two sides to combine with arms of the chair.

The seat frame 3 has a front end with connecting rods 31 engaged to a front end of the chassis 10 and has a rear end with a pivotal rocking board 32 connected with the screw rod 26 by threading. Top faces on two sides of the seat frame 3 have tracks to engage with a sliding base 35 for a chair pad of a chair. A resilient locking board 36 is attached under the seat frame 3 to engage a toothed board 37 on the sliding base 35. The locking board 36 engages the toothed board 37 by resilient force. Because such a performance can be achieved by conventional arts, redundant description is eliminated here.

Figure 3:
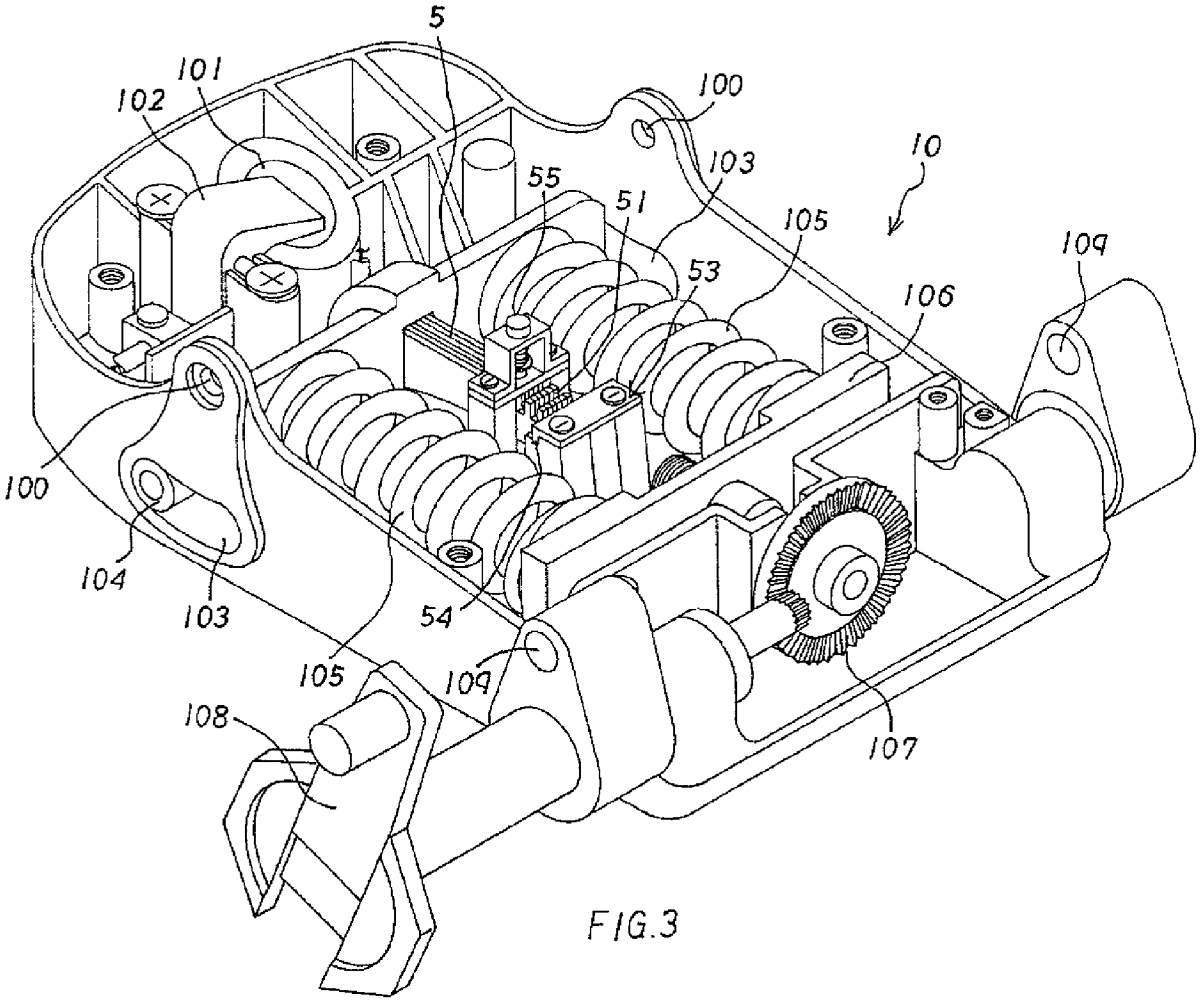
FIG. 3 is a perspective view of a chassis in the chair assembly of the present invention.

The chassis 10 comprises a tube 101 and a wire-controlled triggering element 102 to connect to the pneumatic rod 1 and to control the dish-like base (as shown FIG. 3). A middle section of the chassis 10 has two pivotal holes 100 respectively defined on the two sides of the chassis 10. Each side at the middle section of the chassis further has an elongated slot 103 defined below the pivotal hole 100 to receive a sliding pivotal rod 104 that is abutted by a spring 105 of a pressing board 106. The pressing board 106 is driven by threads on a shaft of an adjusting wheel 107 that is driven by an engagement gear with a transmitting crank 108. Additionally, two combining holes 109 are defined on the two sides of the chassis 10 receiving the connecting rods 31 of the seat frame 3.

Figure 5:
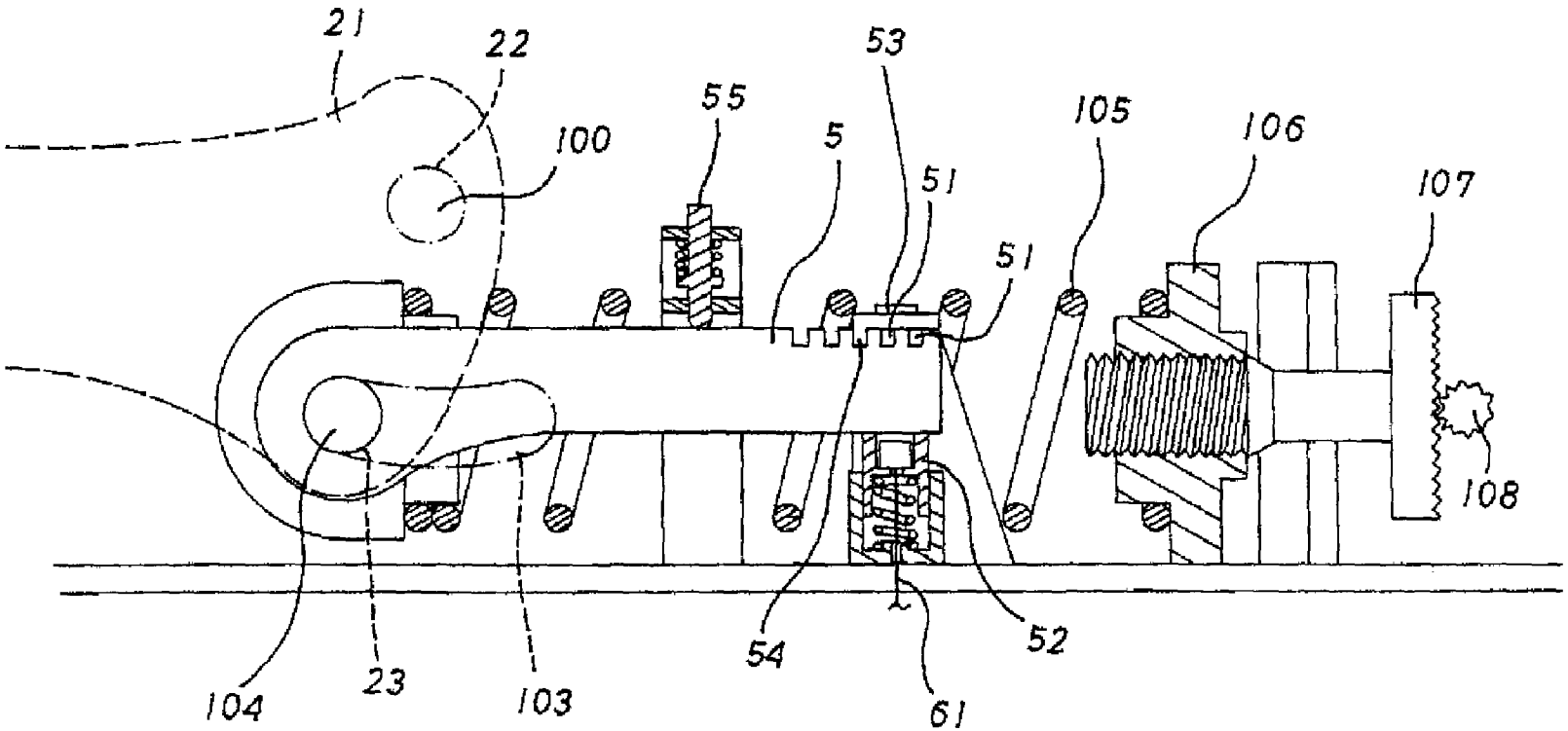
FIG. 5 is a partial, cross-sectional view showing the combination of the backrest frame and the chassis.

By having the abovementioned elements, the tube 101 of the chassis 10 is immovably sleeved on the pneumatic rod 11 (as shown in FIG. 4), with the controlling button 12 aligned with the wire-controlled triggering element 102. Each pivotal hole 22 on the supporting rod 21 of the backrest frame 2 aligns with the corresponding pivotal hole 100 on the chassis 10 for pivotal connection. The engaging hole 23 on the supporting rod 21 aligns with the sliding pivotal rod 104 for pivotal connection (as shown in FIG. 5). Then, each connecting rod 31 of the seat frame 3 pivotally engages the corresponding combining hole 109 of the chassis 10, and the screw rod 26 connects to the rocking board 32 to the backrest frame 2 to achieve assembly of the backrest frame 2 and the seat frame 3.

Figure 6:
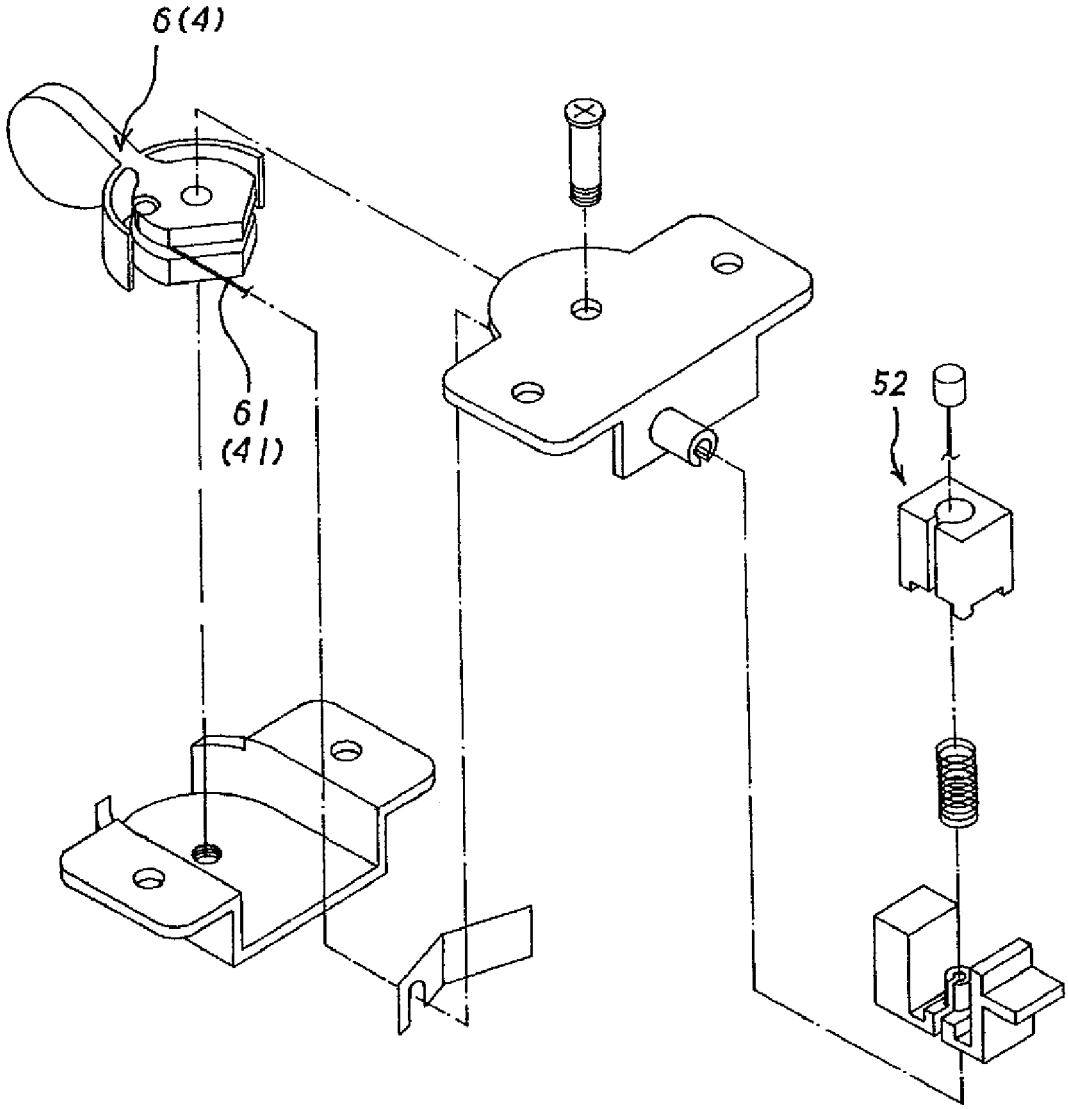
FIG. 6 is an exploded perspective view of an adjustment button and a resilient element.

After assembling the chair assembly, the triggering element 102 is a wire-controlled trigger and moved by the guiding wire 41 driven by an adjusting button 4 (as shown in FIG. 6). When the adjusting button 4 operates, the triggering element 102 presses the controlling button 12 to activate the pneumatic rod 11 to extend or retract so that the elevating height of the chassis 10 is changed. The backrest frame 2 has a driving pressure to pivotally move when the backrest is pushed by the user. Because the pivotal hole 22 on the backrest frame 2 is pivotally engaged with the pivotal hole 100 and because the sliding pivotal rod 104 pivotally combined to the engaging hole 23 has a sliding space in the elongated slot 103, the backrest frame 2 pivotally moves in relation to the chassis 10 when the user's pushing force to the backrest is greater than the resilient force of the spring 105. Therefore, the backrest of the chair assembly pivotally moves forward or backward. Moreover, the resilient force of the spring 105 is adjustable by operating the transmitting crank 108 to change the screwing depth between the adjusting wheel 107 and the pressing board 106. Thus, the spring 105 abutted by the pressing board 106 enables different resilient forces to be provided. Additionally, because the rocking board 32 on the seat frame 3 is threadably combined with the screw rod 26 pivotally connected on the backrest frame 2, the relative distances (changes of the inclined angles between the seat frame 3 and the backrest frame 2) of the backrest frame 2 and the seat frame 3 can be adjusted by the screw rod 26 so that the chair assembly can be adjusted according to different personal needs.

When a user pulls the resilient locking board 36 to disengage the toothed board 37, the pad can be pulled to move the sliding base 35 on the seat frame 3 to adjust the position. After releasing the resilient locking board 36 to engage the toothed board 37 again, the position adjustment of the pad is achieved.

Figure 7:
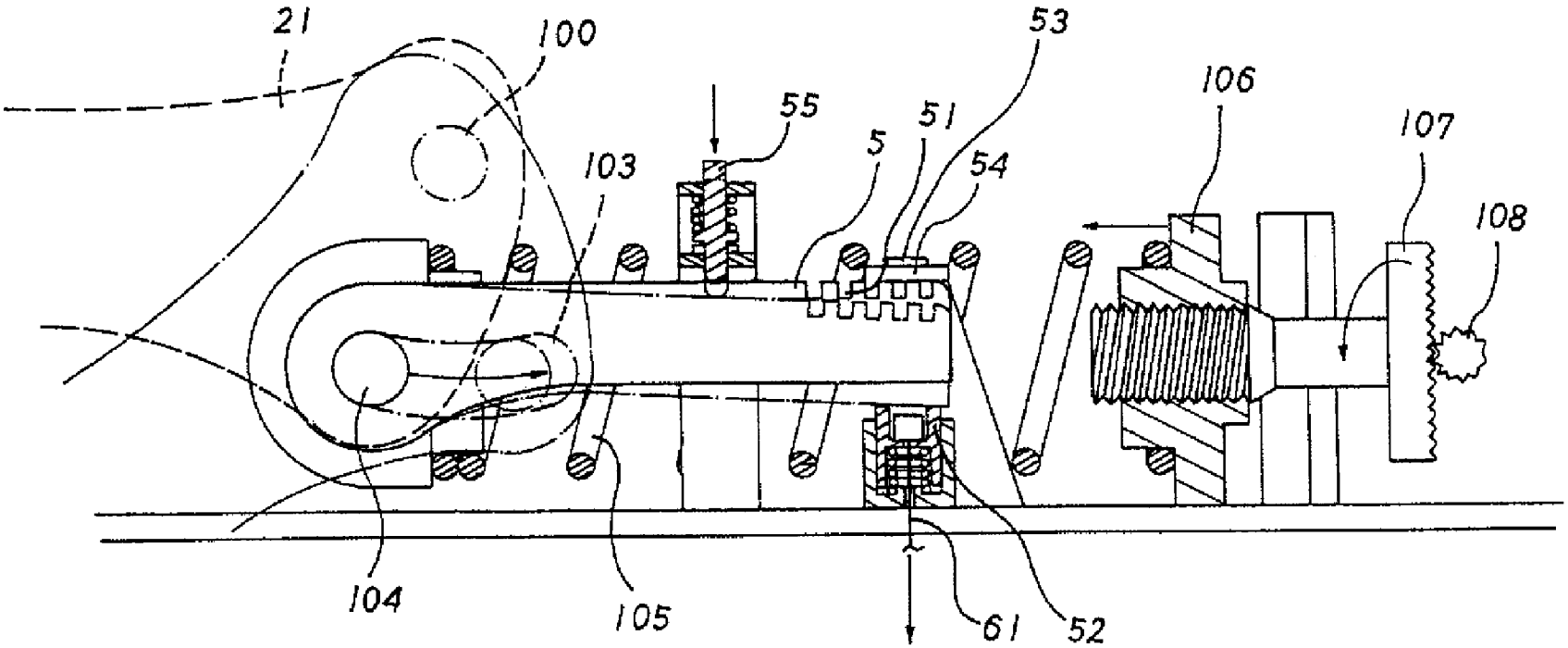
FIG. 7 is an operational cross-sectional view of the backrest frame and the chassis.

Moreover, perpendicularly mounted to each sliding pivotal rod 104 is a toothed rod 5 rested inside a U-frame 53 (as shown in FIGS. 5 and 7) and abutted upward by a resilient element 52 controlled by a guiding wire 61 located below the toothed rod 5 (as shown in FIG. 6). The toothed rod 5 is slightly pressed by a resilient top rod 55. Multiple tooth recesses 51 on the toothed rod 5 are selectively locked by an insertion sheet 54 on the U-frame 53. The resilient top rod 55 only provides a pushing force to the toothed rod 5, but the toothed rod 5 is not pushed from outside. Therefore, when the resilient element 52 is not driven by the adjusting button 6(4) to retract downward, the sliding pivotal rod 104 in the elongated slot 103 is fixed, because the toothed rod 5 is secured by the insertion sheet 54. In this situation, the backrest does not pivotally move. When the resilient element 52 is driven by the guiding wire 61 of the adjusting button 6 to retract downward, the pressing force of the resilient top rod 55 pushes the toothed rod 5 downward to disengage from the insertion sheet 54 so that the backrest can be pushed forward or backward until the backrest frame 2 is adjusted to a desired inclined angle. Then, the user moves the adjusting button 6 to allow the resilient element 52 to move upward to engage one of the tooth recesses 51 on the toothed rod 5 with the insertion sheet 54 again. Particularly, the triggering element 102 and the resilient element 52 are controlled by wires when the guiding wires (41, 61) are driven by the adjusting button (4, 6). Therefore, the adjusting buttons (4, 6) can be attached to locations on the chair without appearance concerns to the chair unlike when the controlling rod is directly connected to the triggering elements in the conventional chair, because the guiding wires (41, 61) wind to extend to and facilitate controlling the triggering element 102 and the resilient element 52.

Although this invention has been described in its preferred form with a certain degree of particularity, it is understood that the present invention of the preferred form has been made only by way of example and that numerous changes in the details of construction and the combination and arrangement of parts any be resorted to without departing from the spirit and scope of the invention.

What is claimed is:

1. A chair assembly comprising a chassis mounted over a pneumatic foot rod, a backrest frame and a seat frame pivotally combined with each other, wherein the pneumatic foot rod is a pneumatic rod immovably mounted on a foot pedestal and has a top surface and a controlling button formed on the top surface;

the backrest frame has a front end and two supporting rods formed on the front end and correspondingly pivotally mounted to two sides of the chassis, with each supporting rod having a pivotal hole and an engaging hole, and with the backrest frame having a rear end with a recess to connect with a backrest;

the seat frame for resting a chair pad has a front end with a connecting rod engaged to a front end of the chassis and has a rear end pivotally attached to the backrest frame; and the chassis comprises a tube engaged to the pneumatic foot rod and comprises a dish-like base, with the controlling button driven by a wire-controlled triggering element of the chassis, with a middle section of chassis having two pivotal holes respectively defined on the two sides of the chassis, with the pivotal holes of the backrest frame and of the chassis being aligned for pivotal connection, with an elongated rod defined on the chassis below each of the two pivotal holes to receive a sliding pivotal rod that is abutted by a spring of a pressing board, with the pressing board driven by threads on a shaft of an adjusting wheel that is driven by an engagement gear with a transmitting crank, and with two engaging holes defined on the two sides at the front end of the chassis.

2. The chair assembly as claim in claim 1, wherein the seat frame has two sides and a sliding base mounted on top faces of the two sides of the seat frame; and the sliding base has a resilient locking board operationally and correspondingly engaged with a toothed board connected to the backrest frame.

3. The chair assembly as claim in claim 1, wherein the sliding pivotal rod is perpendicularly connected with a toothed rod rested inside a U-frame, with the toothed rod abutted by a resilient element controlled by a guiding wire located below the toothed rod; and the toothed rod is slightly pressed by a resilient top rod to selectively lock multiple tooth recesses on the toothed rod with an insertion sheet on the U-frame.

4. The chair assembly as claim in claim 1, wherein the rear end of the backrest frame is pivotally connected to a rocking board to extend downward to threadably and correspondingly connect to a screw rod; and by rotating the screw rod, relative distances between the backrest frame and the seat frame are adjusted.

* * * * *